US006672224B2

(12) United States Patent
Weber et al.

(10) Patent No.: US 6,672,224 B2
(45) Date of Patent: Jan. 6, 2004

(54) RAILWAY CAR TRUCK WITH A ROCKER SEAT

(75) Inventors: Hans B. Weber, Rotonda West, FL (US); Scott R. Duncan, Lake Zurich, IL (US)

(73) Assignee: ASF-Keystone, Inc., Granite City, IL (US)

( * ) Notice: Subject to any disclaimer, the term of this patent is extended or adjusted under 35 U.S.C. 154(b) by 26 days.

(21) Appl. No.: 10/100,576

(22) Filed: Mar. 18, 2002

(65) Prior Publication Data

US 2002/0152923 A1 Oct. 24, 2002

Related U.S. Application Data

(60) Provisional application No. 60/277,930, filed on Mar. 21, 2001.

(51) Int. Cl.[7] ..... B61F 5/00

(52) U.S. Cl. ..... 105/187; 105/208; 105/208.1

(58) Field of Search ..... 105/208.1, 187, 105/171, 213, 185, 186, 208, 208.2, 202, 203, 190.1, 190.2, 199.3

(56) References Cited

U.S. PATENT DOCUMENTS 825,255 A * 7/1906 Whitman ..... 105/187
1,857,345 A * 5/1932 Barber et al. ..... 105/186
3,461,814 A 8/1969 Weber et al.
3,670,660 A 6/1972 Weber et al.
4,955,293 A * 9/1990 Kramer et al. ..... 105/199.3
5,027,716 A * 7/1991 Weber et al. ..... 105/187
5,107,773 A * 4/1992 Daley et al. ..... 105/185
5,222,441 A * 6/1993 Weber ..... 105/208
5,241,913 A 9/1993 Weber
5,463,964 A * 11/1995 Long et al. ..... 105/187
5,544,591 A 8/1996 Taillon
5,802,982 A * 9/1998 Weber ..... 105/187
6,142,081 A 11/2000 Long et al.

* cited by examiner

*Primary Examiner*—S. Joseph Morano
*Assistant Examiner*—Frantz F. Jules
(74) *Attorney, Agent, or Firm*—Edward J. Brosius

(57) ABSTRACT

A railway car truck having a pair of side frames and a bolster and a transom extending transversely between the side frames. A respective rocker seat is rigidly and permanently attached to each end of the transom and is pivotally supported on a rocker bar that is supported by the tension member of a sideframe. The pivotal connection between the rocker seat and the rocker bar disposes the transom perpendicular to the side frame and provides pivotal movement of the side frame with respect to the transom. The railway car truck is assembled by inserting the ends of the bolster and transom into the window of a side frame, and then inserting the rocker bar through a passageway in the side frame to a position under the rocker seat and on the bottom tension member of the side frame. Springs are then inserted between the transom and the bolster such that the bolster is resiliently supported on the side frame.

8 Claims, 5 Drawing Sheets

RAILWAY CAR TRUCK WITH A ROCKER SEAT

RELATED APPLICATIONS

This application claims the benefit of U.S. Provisional Application No. 60/277,930, filed Mar. 21, 2001.

BACKGROUND OF THE INVENTION

The present invention is directed to a railway car truck having a pair of side frames and a bolster and a transom extending transversely between the side frames, wherein a respective rocker seat is rigidly and permanently attached to each end of the transom and is pivotally supported on a rocker bar that is supported by the tension member of a side frame.

The railway car truck described in U.S. Pat. No. 3,670,660 was developed to address problems of lateral instability of railway car trucks due to truck hunting at high speed service, to provide a smooth ride and to reduce maintenance. The railway car truck of U.S. Pat. No. 3,670,660 provides hunting-free operation by using the side frames of the truck as swing hangers and by interconnecting the side frames with a transom to rigidize the truck to increase lozenging stiffness.

Over the last several years developments in railway car construction has made the cars lighter, such that additional restraint is required in the side frame to transom connection to prevent hunting. Bolting of the transom to the rocker seats is one way to introduce additional restraint. However, in the railway car truck of U.S. Pat. No. 3,670,660, this can only be done after the rocker seats and transom are separately assembled into the side frames of the truck. This leaves room for potential assembly errors. If the truck is not one-hundred percent square at the time of assembly, the tolerances in the bolt holes in the rocker seat and in transom could permit an out of squareness (lozenging) of 0.4056 inch across the rail. A condition like this could lead to one-sided flange contact of the truck wheels with the rail and resulting wear to the wheels. The surface conditions of the rocker seats and of the transom at their interface can also further alter the correct and desired amount of restraint therebetween. The present invention provides the desired amount of restraint between the transom and rocker seat and enables the railway car truck to operate hunting-free without lozenging and allows the rocker seats to be preassembled to the transom.

SUMMARY OF THE INVENTION

A railway car truck having first and second side frames that are spaced apart and parallel to one another, and a bolster and a transom that extend transversely between the first and second side frames. Each side frame includes a central axis, a bottom tension member, a top compression member, first and second spaced apart columns extending between the bottom tension member and the top compression member, and a window located between the bottom tension member and the top compression member and between the first and second columns. The transom includes a first end, a second end and a central axis. Each end of a transom is located within a window of a respective side frame. Rocker connections pivotally support each end of the transom on the bottom tension member of a respective side frame. Each rocker connection includes a rocker seat attached to the end of the transom and a rocker bar removably supported on the bottom tension member of the side frame. The rocker seat includes a rocker bearing having a generally cylindrical-shaped concave bearing surface and a central axis. The central axis of the rocker bearing is perpendicular to the central axis of the transom. The rocker bar includes a generally cylindrical-shaped convex bearing surface adapted to pivotally engage the concave bearing surface of the rocker seat. The convex bearing surface of the rocker bar has a central axis located parallel to the central axis of the side frame. The pivotal engagement of the rocker bar with the rocker seat disposes the central axis of the transom perpendicular to the central axis of the side frame. The rocker bar and the side frame are pivotal with respect to the rocker seat and to the transom about the central axis of the rocker bar.

The railway car truck is assembled by attaching a rocker seat to each end of the transom such that the central axis of the bearing surface of each rocker seat is perpendicular to the central axis of the transom. The bolster is placed on top of the transom and generally parallel to the transom. The ends of the bolster and of the transom are inserted into a window of a side frame such that the transom is spaced apart from the bottom tension member of the side frame. The rocker bar is inserted through a passageway in the side frame to the window of the side frame where the rocker bar is placed under the rocker seat and within pockets on the bottom tension member of the side frame. The transom is lowered until the bearing surface of the rocker seat pivotally engages the bearing surface of the rocker bar. A plurality of springs are inserted between the transom and the bolster. The bolster is then lowered onto the springs.

DETAILED DESCRIPTION OF THE PREFERRED EMBODIMENT

Figure 1:
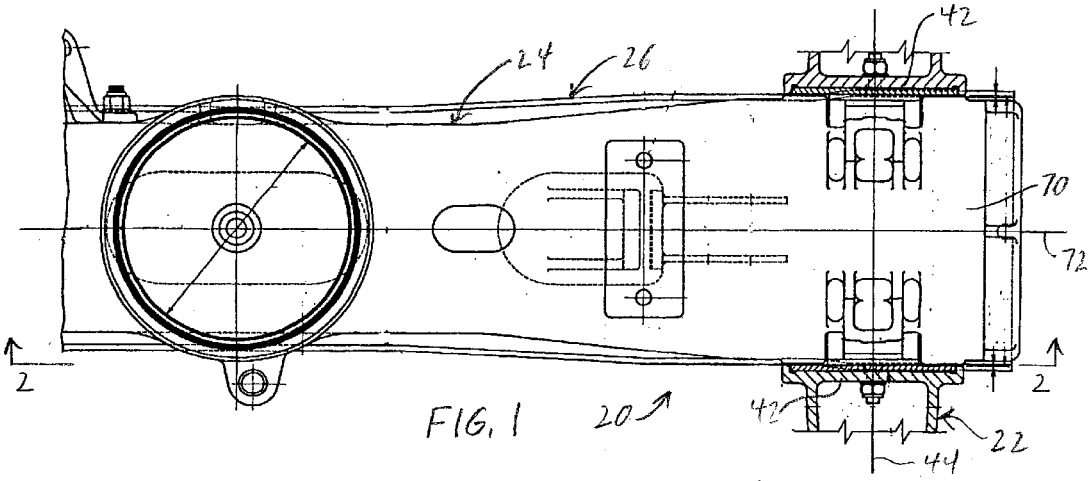
FIG. 1 is a partial top plan view of the railway car truck of the present invention.

The railway car truck 20 of the present invention includes two side frames 22, a bolster 24, and a transom 26. It is to be understood that while FIGS. 1 and 2 show one half of the bolster 24 and transom 26, the remaining half of each is constructed in the same manner as the half that is shown, and that while FIG. 3 shows one half of the side frame 22, the remaining half of the side frame is constructed in the same manner as the half that is shown.

Figure 3:
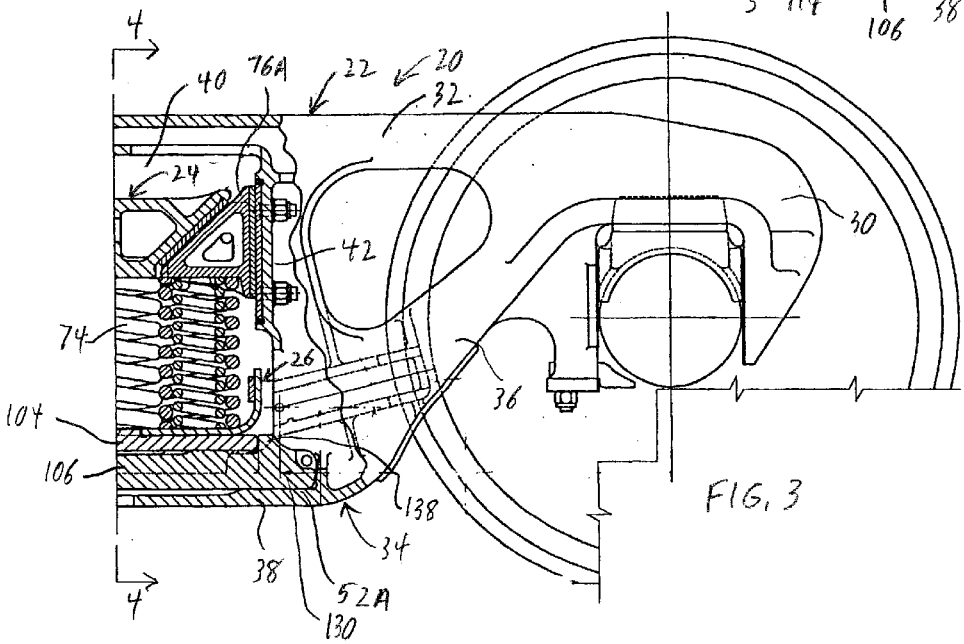
FIG. 3 is a partial cross sectional side view of the railway car truck.
Figure 5:
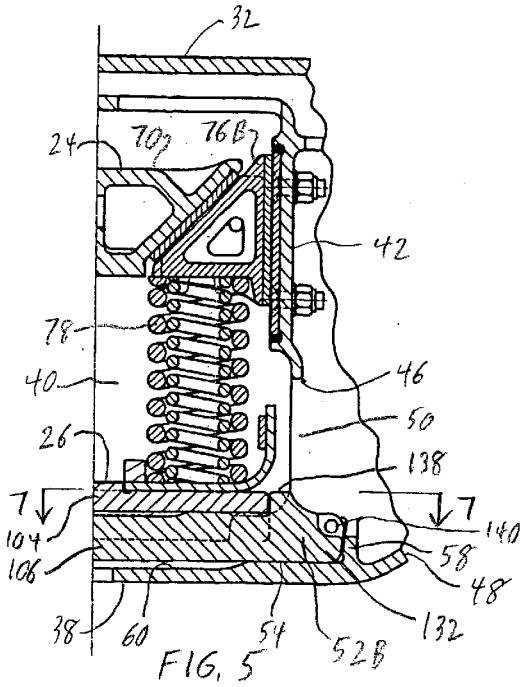
FIG. 5 is a partial cross sectional view taken along line 5—5 of FIG. 2.
Figure 6:
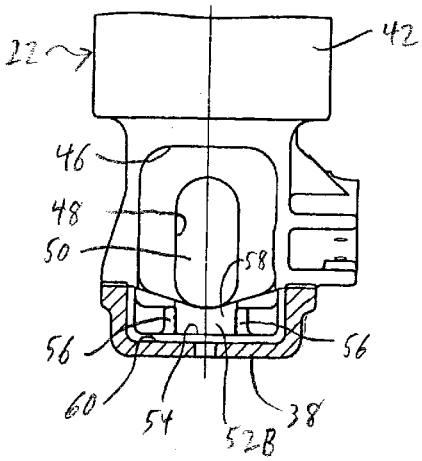
FIG. 6 is a partial cross sectional view of the side frame taken through the window of the side frame.
Figure 7:
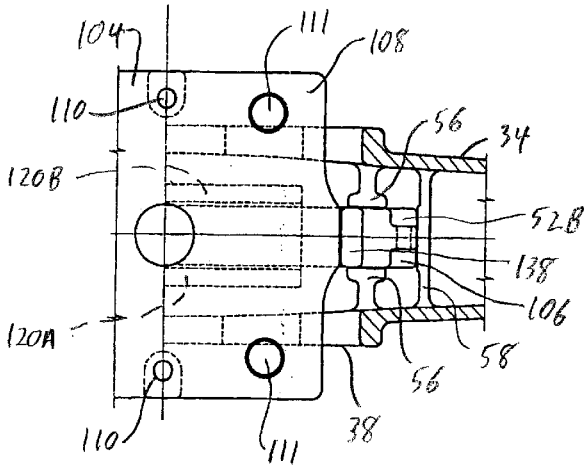
FIG. 7 is a partial cross sectional view taken along line 7—7 of FIG. 5.

As best shown in FIG. 3, each side frame 22 includes a pedestal 30 at each end. Each pedestal 30 is adapted to receive the axle of a wheel set including two wheels. A top compression member 32 and a bottom tension member 34 extend between the pedestals 30. The bottom tension member 34 includes two inclined members 36 and a generally horizontal bottom member 38 that extends between the two inclined members 36. The side frame 22 includes a window 40 located between the bottom member 38 and the top compression member 32, and between two spaced apart columns 42 that extend generally vertically between the top compression member 32 and the bottom tension member 34. The side frame 22 includes a central axis 44 which extends from a first end to a second end of the side frame 22. As best shown in FIGS. 5 and 6, each column 42 includes an opening 46 in communication with the window 40. The bottom tension member 34 of the side frame 22 also includes two openings 48, one on each side of the window 40. A passageway 50 extends from each opening 48 to a respective opening 46 and thereby extends from the exterior of the side frame 22 to the window 40.

As best shown in FIG. 6, the bottom member 38 of the bottom tension member 34 of the side frame 22 is generally U-shaped in cross section. As best shown in FIGS. 3 and 5, a pocket 52A and 52B is respectively formed at each end of the bottom member 38. Each pocket 52A–B includes a generally planar and horizontal bottom surface 54, a pair of spaced apart side walls 56 extending upwardly from opposite sides of the bottom surface 54, and an end wall 58. The side walls 56 and end wall 58 are generally located in a U-shape when viewed in plan. The pockets 52A–B are open upwardly and toward the center of the side frame 22. As best shown in FIG. 5, the bottom surface 54 of the pockets 52A–B is located at an elevation above the interior surface 60 of the bottom member 38.

Figure 2:
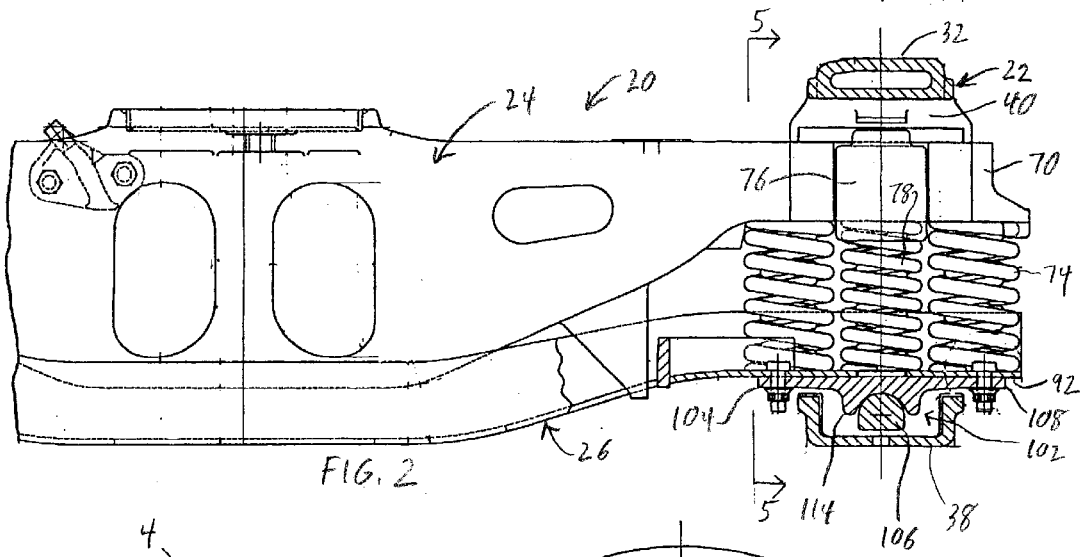
FIG. 2 is a partial cross sectional side view taken along line 2—2 of FIG. 1.

As shown in FIGS. 1 and 2, the bolster 24 extends between a pair of spaced apart ends 70. The bolster 24 includes a central axis 72 that extends between the two ends 70. Each end 70 of the bolster 24 is respectively adapted to be inserted into the window 40 of a respective side frame 22 such that the side frames 22 are spaced apart and generally parallel to one another, and such that the bolster 24 is located transversely to the side frames 22 at a right angle, such that the truck is formed in a generally "H" shape. As shown in FIGS. 2 and 3, each end 70 of the bolster 24 is resiliently supported by plurality of springs 74. A pair of friction wedges 76 is respectively located between the ends 70 of the bolster 24 and each column 42 of the side frames 22 and is resiliently supported by one or more springs 78.

Figure 8:
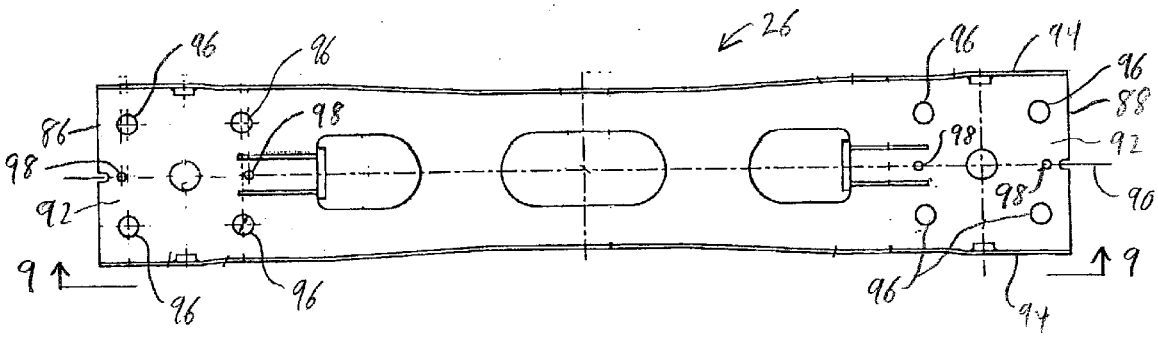
FIG. 8 is a top plan view of the transom of the railway car truck.
Figure 9:
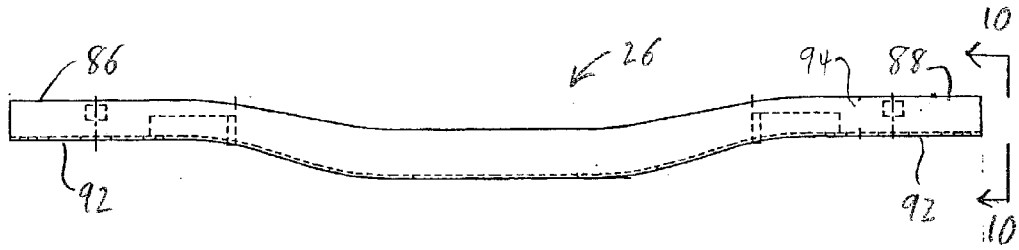
FIG. 9 is a side elevational view taken along line 9—9 of FIG. 8.
Figure 10:
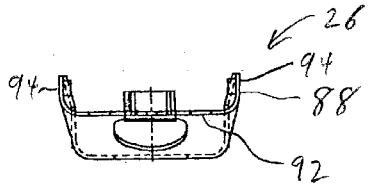
FIG. 10 is an end view taken along line 10—10 of FIG. 9.
Figure 11:
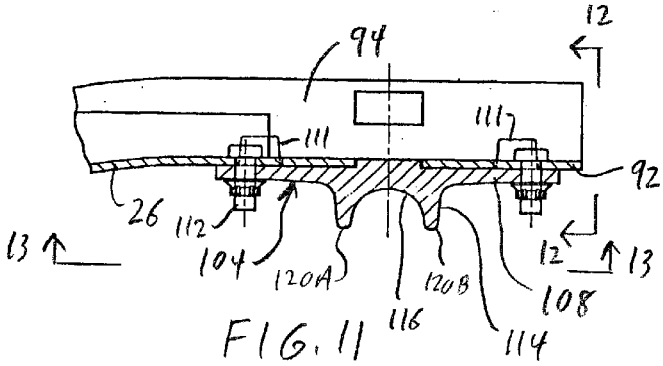
FIG. 11 is a partial cross sectional view showing the connection of the rocker seat to the transom.
Figure 12:
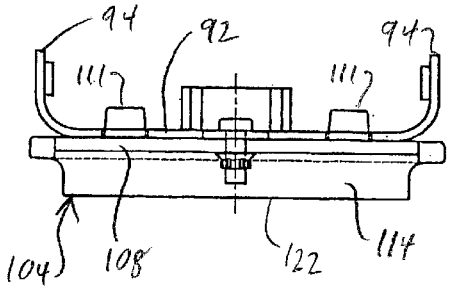
FIG. 12 is an end view taken along line 12—12 of FIG. 11.
Figure 13:
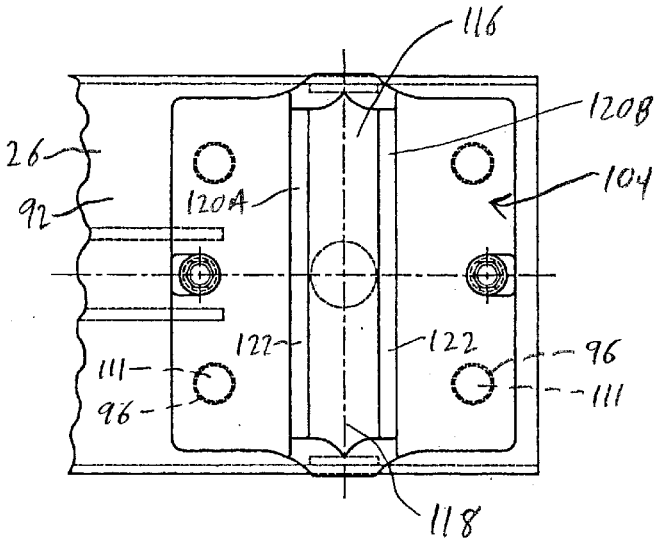
FIG. 13 is a bottom view taken along lines 13—13 of FIG. 11.
Figure 14:
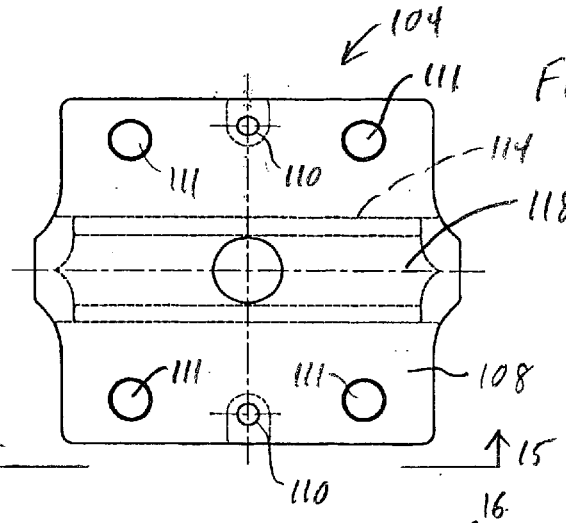
FIG. 14 is a top plan view of the rocker seat.
Figure 15:
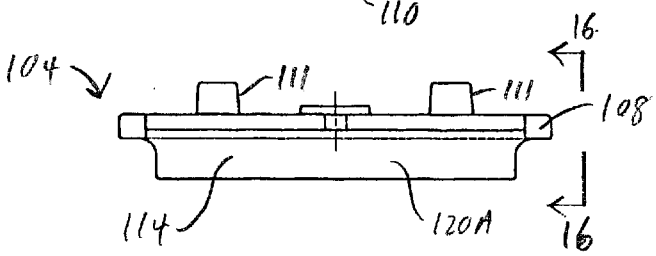
FIG. 15 is a side elevational view of the rocker seat taken along line 15—15 of FIG. 14.
Figure 16:
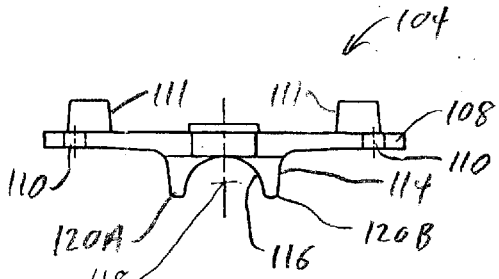
FIG. 16 is a side elevational view taken along line 16—16 of FIG. 15.
Figure 17:
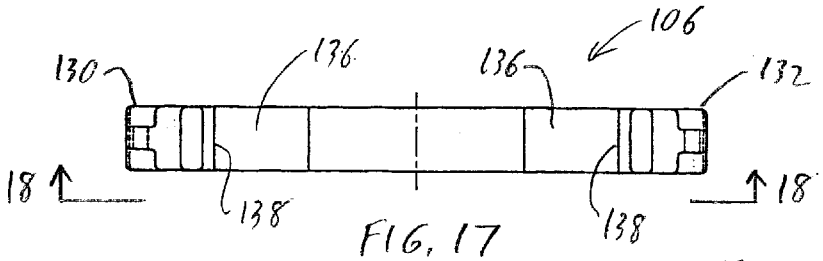
FIG. 17 is a top plan view of the rocker bar.
Figure 18:
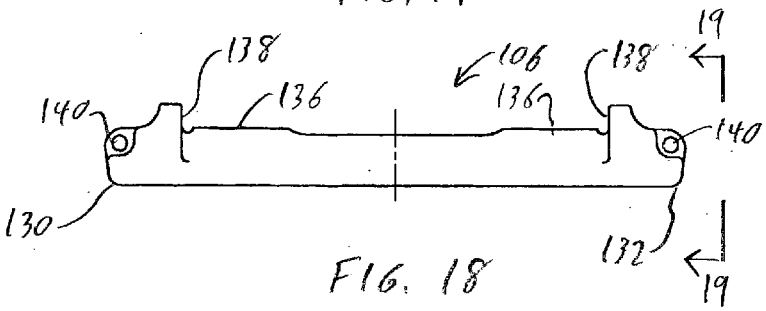
FIG. 18 is a side elevational view of the rocker bar taken along line 18—18 of FIG. 17.
Figure 19:
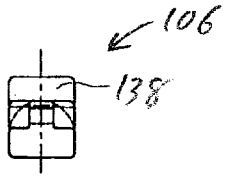
FIG. 19 is an end view of the rocker bar taken along line 19—19 of FIG. 18.

The transom 26 as best shown in FIGS. 8–10 includes a first end 86 and a second end 88. A central axis 90 extends between the first and second ends 86 and 88. The transom 26 is generally U-shaped in cross section as best shown in FIG. 10. Each end 86 and 88 includes a generally planar and horizontal web 92 which extends between a pair of opposing and upstanding flanges 94. The web 92 at each end 86 and 88 includes a plurality of apertures 96, such as four apertures located in a generally rectangular pattern with respect to one another. Each end 86 and 88 of the web 92 also includes two apertures 98 located along the central axis 90. As best shown in FIGS. 1 and 2, each end of the transom 26 is adapted to be located within the window 40 of a respective side frame 22 such that the transom 26 is located below the bolster 24. The central axis 90 of the transom 26 is located generally parallel to the central axis 72 of the bolster 24 in a common vertical plane. The central axis 90 of the transom 26 and the central axis 72 of the bolster 24 are located transversely at a right angle to the central axes 44 of the side frames 22.

Each end 86 and 88 of the transom 26 is pivotally supported on the bottom tension member 34 of a respective side frame 22 by a rocker connection 102. The rocker connection 102 includes a rocker seat 104 and a rocker bar 106. Each rocker seat 104 includes a generally rectangular plate 108 having a plurality of apertures 110 and a plurality of upstanding posts 111. The plate 108 is adapted to engage the bottom surface of the web 92 of the transom 26 such that each aperture 110 in the rocker seat 104 is aligned in registration with a respective aperture 98 in the transom 26 and such that each post 111 extends into a respective aperture 96 in the web 92 of the transom 26. The plate 108 is attached to the web 92 of the transom 26 by a plurality of fasteners 112. The fasteners 112 are preferably threaded fasteners such as bolts and nuts. Alternatively, the plate 108 may be attached to the web 92 of the transom 26 by welding. The rocker seat 104 includes a rocker bearing 114 attached to the bottom surface of the plate 108. The rocker bearing 114 includes a concave generally-cylindrical bearing surface 116 formed about and along a central axis 118 by a radius extending from the central axis 118. The central axis 118 is located parallel to the central axis 44 of the side frame 22 and in a common vertical plane with the central axis 44. The rocker bearing 114 includes downwardly extending skirts 120A and 120B that are spaced apart and generally parallel to one another. The concave bearing surface 116 is located between the skirts 120A–B. The skirts 120A–B extend generally linearly in a direction parallel to the central axis 118. Each skirt 120A and B includes a tip 122. If desired the plate 108 may be integrally formed with the web 92 of the transom 26, or the rocker bearing 114 may be attached to or integrally formed with the web 92 of the transom 26 without use of a plate 108.

Figure 4:
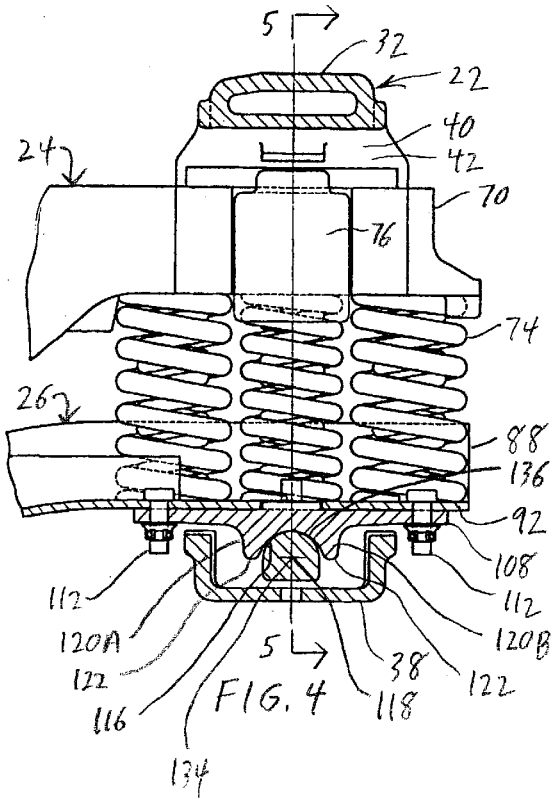
FIG. 4 is a partial cross sectional view taken along line 4—4 of FIG. 3.

The rocker bar 106 includes a first end 130, a second end 132 and a central axis 134 that extends from the first end 130 to the second end 132. The rocker bar 106 includes a convex generally cylindrical-shaped bearing surface 136 formed by a radius extending from the central axis 134, which is approximately the same length as the radius that forms the bearing surface 116. The bearing surface 136 is located on the upper portion of the rocker bar 106 and between the ends 130 and 132. The bearing surface 136 is adapted to pivotally engage the bearing surface 116 of the rocker bearing 114 such that the central axis 134 is generally colinear with the central axis 118 and such that the rocker bar 106 can rock or pivot about the central axis 134 with respect to the rocker seat 104. Each end 130 and 132 of the rocker bar 106 includes an upwardly extending longitudinal stop member 138. The plate 108 of the rocker seat 104 is adapted to be located between the stop members 138 such that the stop members 138 will prevent movement of the rocker seat 104 and transom 26 in a direction parallel to the central axis 44 of the side frame 22. As shown in FIGS. 3 and 5, each end 130 and 132 of the rocker bar 106 is adapted to be received in a respective pocket 52A and B in the bottom tension member 34 of a side frame 22. Each end 130 and 132 includes an end wall adapted to engage the end wall 58 of the pockets 52A and B, and a pair of side walls that are adapted to respectively engage the side walls 56 of the pockets 52A and B. The pockets 52A and B thereby prevent longitudinal and transverse movement of the rocker bar 106 with respect to the side frame 22, while allowing the rocker bar 106 to be lifted vertically out of the pockets 52A and B. Each end 130 and 132 of the rocker bar 106 includes an eye 140 adapted to assist in the insertion or removal of the rocker bar 106 from the bottom member 38 of the side frame 22. As shown in FIGS. 4 and 5, the bottom surface of the rocker bar 106 is spaced above the interior surface of the bottom member 38 of the bottom tension member 34 between the pockets 52A and B.

In operation, the rocker bearings 114 transfer vertical forces from the bolster 24 to the rocker bar 106 approximately mid-way of the side frames 22, but still as close as possible to the columns 42 of each side frame 22. The rocker seats 104 and the rocker bars 106 maintain the side frames 22 at a right angle to the central axis 72 of the bolster 24 while permitting the swinging or pivoting of the side frames 22 in a lateral direction about the axis 134.

The railway car truck 20 is assembled by connecting the two rocker seats 104 to the ends 86 and 88 of the transom 26 such that the central axes 118 are perpendicular to the central axis 90 of the transom 26. The two side frames 22 are placed on the outside of a pair of assembly rails (not shown), parallel to the rails and spaced wide enough apart such that the transom 26 and bolster 24 can be placed between the side frames 22 at right angles to the side frames, and at a right angle to the track. The bolster 24 and transom 26 are placed between the side frames 22 and are aligned with the windows 40 in the side frames 22. The bolster 24 is placed onto the transom 26 without the friction wedges 76A–B or springs 74 and 78 being placed therebetween. The bolster 24 is then removably attached to each end of the transom 26 by chains or slings. The side frames 22 are then lifted upright and the ends of the bolster 24 and transom 26 are fed into the windows 40 of the side frames 22. The bolster and transom assembly is then lifted until the bolster ends 70 are located between the friction plates of the columns 42 and until the tops of the flanges 94 of the transom 26 engage the columns 42 adjacent the bottom end of the friction plates.

The rocker bars 106 are then inserted under the rocker seats 104 of the transom 26 by inserting the rocker bars 106 through a passageway 50 in each side frame 22 such that the ends 130 and 132 of the rocker bar 106 are placed into a respective pocket 52A and B of the bottom tension member 34 of the side frame 22. The transom and bolster assembly is then lowered until the rocker bearing 114 of the rocker seat 104 bears on the bearing surface 136 of the rocker bar 106. The chains or slings that are connecting the bolster 24 to the transom 26 are then removed. The bolster 24 is then lifted until the top side of the bolster ends 70 contact the underside of the top compression members 32 above the windows 40. The friction wedges 76A–B and the springs 74 and 78 are then installed. The bolster 24 is then lowered to rest on the springs. The truck assembly comprising the two side frames 22, the bolster 24 and transom 26 may then be placed over a pair of wheel sets for mounting. The railway car truck 20 can be disassembled in a reverse procedure.

The railway car truck 20 of the present invention permits the rocker seats 104 to be connected to the transom 26 before the transom 26 and bolster 24 are assembled with the side frames 22. This permits the mounting of the rocker seats 104 to the transom 26 using mounting jigs or fixtures such that the central axis 118 of the rocker bearing 114 can be accurately aligned at a true right angle to the central axis 90 of the transom 26, and therefore parallel to the central axes 44 of the two side frames 22. Lozenging of the truck 20 is prevented by the strong, secure and accurately aligned connection of the rocker seats 104 to the transom 26 such that the truck 20 provides hunting-free performance.

The skirts 120A and B extend downwardly from the plate 108 a sufficient distance to wrap around the sides of the rocker bar 106 such that transom ends 86 and 88, with mounted rocker seats 104, would not have sufficient space in the entry opening of window 40 of the frame to allow the tip 122 of a skirt 120A and B to be moved over the top of the rocker bar 106 when the truck 20 is assembled. The skirts 120A and B thereby prevent disengagement of the rocker seat 104 from the rocker bar 106 to thereby hold the truck 20 together even in the event of a derailment. This design feature requires the insertion of the rocker bar 106 through the passageway 50. If desired, the skirts 120A and B on the rocker seat 104 could be shortened to permit enough room such that the skirts 120A and B can pass over the top of the rocker bar 106. In this case the rocker bar 106 could be placed in its position within the pockets 52A and B of the bottom tension number 34 before the rocker seat 104, transom 26 and bolster 24 are inserted into the window 40 and without the need to utilize the passageway 50. There would still be a large amount of overlap between the skirts 120A and B with the rocker bar 106 to prevent an inadvertent disengagement.

The present invention thereby allows the assembly and disassembly of the railway car truck 20 with the rocker seats 104 attached to the transom 26. The preassembly of the rocker seats 104 to the transom 26 provides better control of tolerances, alignment, surface conditions of the mating surfaces, and torquing of the fasteners. The number of parts that are required to be stored, shipped and handled is reduced, and the number of possible assembly errors is reduced. The amount of dirt accumulation in the rocker connection is also reduced as the concave bearing surface 116 is located above the convex bearing surface 136.

Various features of the invention have been particularly shown and described in connection with the illustrated embodiment of the invention, however, it must be understood that these particular arrangements merely illustrate, and that the invention must be given its fullest interpretation within the terms of the appended claims.

What is claimed is:

1. A railway car truck comprising:

a side frame including a central axis, a bottom tension member, a top compression member, first and second spaced apart columns extending between said bottom tension member and said top compression member, and a window located between said bottom tension member and said top compression member and between said first and second columns;

a transom having a first end, a second end and a central axis, said first end of said transom located within said window of said side frame; and a rocker connection pivotally supporting said first end of said transom on said bottom tension member of said side frame, said rocker connection including a rocker seat attached to said first end of said transom and a rocker bar removably supported on said bottom tension member of said side frame, said rocker seat including a rocker bearing having a concave bearing surface and a central axis, said central axis of said rocker bearing being perpendicular to said central axis of said transom, said rocker bar including a convex bearing surface adapted to pivotally engage said concave bearing surface of said rocker seat, said convex bearing surface of said rocker bar having a central axis located parallel to said central axis of said side frame;

whereby the engagement of said rocker with said rocker seat disposes said central axis of said transom perpendicular to said central axis of said side frame, and such that said rocker bar and said side frame are pivotal with respect to said rocker seat and to said transom about said central axis of said rocker bar, and wherein said bottom member of said side frame includes a first opening and a first pocket to adapted to removably receive said rocker bar, and said first column includes a second opening, said first and second openings forming a passageway through said side frame in communication with said window such that said rocker bar can be passed through said passageway and positioned within said first pocket.

2. The railway car truck of claim 1, wherein said bottom tension member includes a second pocket, said first and second pockets adapted to receive respective ends of said rocker bar and adapted to prevent longitudinal movement of said rocker bar with respect to side frame.

3. The railway car truck of claim 1 wherein said concave bearing surface and said convex bearing surface are each generically cylindrical-shaped.

4. The railway car truck of claim 1 wherein said rocker bearing includes first and second downwardly extending skirts, each said skirt being located on a respective side of said concave bearing surface, said skirts adapted to prevent inadvertent disengagement of said rocker bar from said rocker seat.

5. The railway car truck of claim 1 wherein said rocker seat includes a plate adapted to be attached to said transom, said rocker bearing being attached to said plate.

6. The railway car truck of claim 1 wherein said rocker bar includes a stop member adapted to engage said rocker seat to prevent longitudinal movement of said rocker seat with respect to said side frame.

7. The railway car truck of claim 1 including a bolster having a first end and a second end, said bolster being located above said transom with said first end of said bolster located in said window, and a plurality of springs extending between said first end of said transom and said first end of said bolster.

8. A rocker bar adapted to be removably supported on the bottom tension member of a side frame and to pivotally engage a rocker seat, said rocker bar comprising:

a first stop member located at first end of said rocker bar;

a second stop member located at a second end of said rocker bar;

a generically cylindrical-shaped convex bearing surface located between said first and second stop members, said convex bearing surface adapted to pivotally engage the rocker seat, wherein said rocker bar includes an eve adapted to assist in the removal of said rocker bar from the bottom tension member of the side frame.

* * * * *